US006408747B2

(12) United States Patent
Koppelkamm et al.

(10) Patent No.: US 6,408,747 B2
(45) **Date of Patent: *Jun. 25, 2002**

(54) OFFSET PRINTING UNIT

(75) Inventors: Günter Koppelkamm, Neuensalz; Ralf Schädlich; Johannes Behmel, both of Plauen, all of (DE)

(73) Assignee: MAN Roland Druckmaschinen AG, Offenbach am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/241,884

(22) Filed: Feb. 1, 1999

(30) Foreign Application Priority Data

Jan. 31, 1998 (DE) ..... 198 03 809

(51) Int. Cl.[7] ..... B41L 23/00
(52) U.S. Cl. ..... 101/147; 101/219
(58) Field of Search ..... 101/219–221, 101/147

(56) References Cited

U.S. PATENT DOCUMENTS

| | | | | | |
|---|---|---|---|---|---|
| 1,310,658 | A | * | 7/1919 | Hope | |
| 3,335,663 | A | * | 8/1967 | Harenza | 101/415.1 |
| 3,696,745 | A | * | 10/1972 | Morton | 101/415.1 |
| 4,029,013 | A | * | 6/1977 | George et al. | 101/382 |
| 4,694,749 | A | * | 9/1987 | Takeuchi et al. | 101/426 |
| 4,833,486 | A | * | 5/1989 | Zerillo | 346/1.1 |
| 4,899,657 | A | * | 2/1990 | Kondo et al. | 101/451 |
| 4,936,211 | A | * | 6/1990 | Pensavecchia et al. | 101/136 |
| 5,205,039 | A | * | 4/1993 | Ternes | 29/895.21 |
| 5,640,906 | A | * | 6/1997 | Schmitt | 101/177 |

FOREIGN PATENT DOCUMENTS

| | | | |
|---|---|---|---|
| DE | 27 06 565 | 8/1977 | B41F/7/08 |
| DE | 31 15 475 | 11/1982 | B41F/13/42 |
| DE | 36 44 445 | 7/1988 | B41F/7/12 |
| DE | 8816452.7 | 7/1988 | B41F/7/12 |
| DE | 35 27 912 | 12/1989 | C23C/4/04 |
| DE | 43 37 554 | 6/1994 | B41F/7/02 |
| DE | 43 07 320 | 7/1994 | B41N/10/00 |
| DE | 43 03 904 | 8/1994 | B41F/7/10 |
| DE | 44 08 025 | 9/1995 | B41F/7/04 |
| DE | 44 29 891 | 2/1996 | B41F/7/12 |
| DE | 44 35 429 | 4/1996 | B41F/13/00 |
| DE | 44 14 836 | 1/1997 | B41F/13/42 |
| DE | 43 20 464 | 3/1997 | B41F/13/10 |
| DE | 195 34 651 | 3/1997 | B41F/13/26 |
| DE | 195 48 819 | 7/1997 | B41F/13/02 |
| DE | 196 03 663 | 8/1997 | B41F/13/34 |
| DE | 44 14 084 | 9/1997 | B41F/13/26 |
| EP | 0 182 156 | 10/1985 | B41F/7/02 |
| EP | 0 133 498 | 9/1989 | B41F/7/12 |
| FR | 2.193.714 | 7/1973 | B41F/7/14 |
| GB | 2 273 464 | 6/1994 | B41F/7/12 |

* cited by examiner

*Primary Examiner*—Eugene Eickholt
(74) *Attorney, Agent, or Firm*—Cohen, Pontani, Lieberman & Pavane

(57) ABSTRACT

An offset printing unit includes at least one cylinder pair with a form cylinder and a transfer cylinder. The transfer cylinder cooperates with an impression cylinder in such a way that ink can be applied to a printing material web guided between the transfer cylinder and the impression cylinder. In order to permit the economic production of multifarious products with a relatively low technical outlay, the form cylinder is fitted in the circumferential direction with one, and in the longitudinal direction with at least four, portrait printed pages in broadsheet format. The form cylinder may optionally be fitted with landscape printed pages in tabloid format or portrait or landscape printed pages in book format. A circumference of the form cylinder receives one flexible printing plate and a longitudinal length of the form cylinder receives at least one flexible printing plate. The circumference of the transfer cylinder and the circumference of the impression cylinder in each case is an integral multiple of the circumference of the form cylinder.

15 Claims, 13 Drawing Sheets

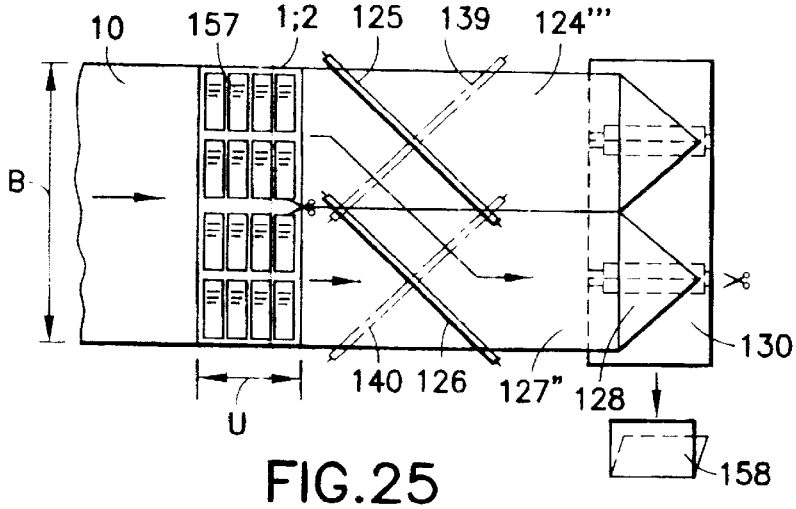
FIG.25
FIG.26
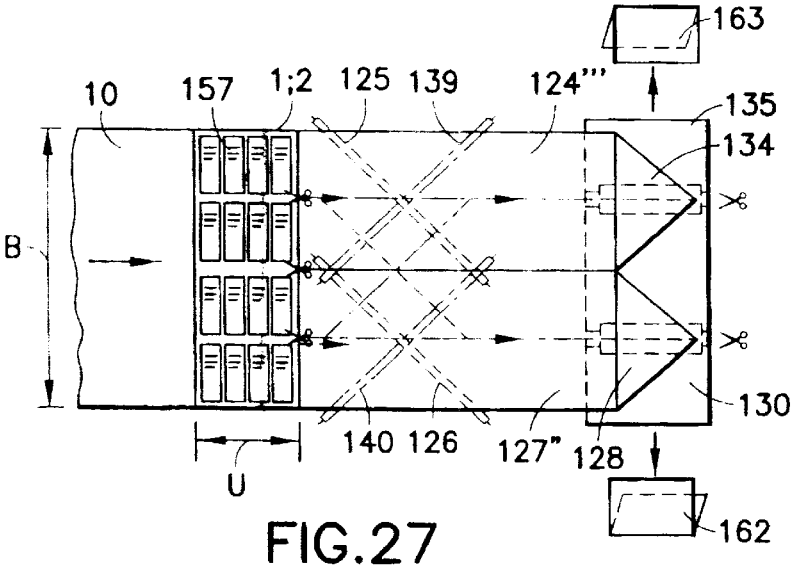
FIG.27
FIG.28

OFFSET PRINTING UNIT

BACKGROUND OF THE INVENTION

1. Field of the Invention

The invention relates to an offset printing unit having an impression cylinder and a cylinder pair including a form cylinder and a transfer cylinder for applying ink to a printing material web guided between the transfer cylinder and the impression cylinder.

2. Description of the Related Art

Offset printing units having a cylinder pair including a form cylinder and a transfer cylinder and whose transfer cylinder cooperates with an impression cylinder for applying ink to a printing material web guided between the transfer cylinder and the impression cylinder are generally known. In offset printing units used for newspaper printing, the form cylinder may be configured with one printed page in the circumferential direction and two printed pages in the longitudinal direction, or two printed pages in the circumferential direction and two printed pages in the longitudinal direction, or two printed pages in the circumferential direction and four printed pages in the longitudinal direction, depending on the configuration of the printing unit. In each of these configurations, the printed pages are arranged in portrait fashion in a broadsheet format.

SUMMARY OF THE INVENTION

It is the object of the invention to create an offset printing unit which permits the economic production of multifarious products with a relatively low technical outlay.

The following definitions apply to terms used throughout the specification and claims: "Broadsheet" refers to the size of one printed page of a newspaper format and "tabloid" refers to a printed page in a magazine format which is half as large as the "broadsheet" printed page. Furthermore, "broadsheet" pages are printed so that the pin holes (puncture holes) of the paper are arranged on the bottom of the page and "tabloid" printed pages have the pin holes arranged along a side of the page.

This object is achieved by an offset printing machine including a printing unit having an impression cylinder and at least one cylinder pair including a form cylinder and a transfer cylinder operatively arranged so that ink is applicable from the transfer cylinder to a printing material web guidable between the transfer cylinder and the impression cylinder. The form cylinder has an outer surface with a circumferential length and a longitudinal length configured such that each of a first, second, third and fourth print page array is independently fittable within the outer surface of the form cylinder. The first print page array is in a broadsheet format and includes one portrait printed page in the circumferential length and at least four portrait printed pages in the longitudinal length, the second print page array is in a book format and includes two landscape printed pages in the circumferential length and at least four landscape printed pages in the longitudinal length, the third print page array is in a book format and includes two portrait printed pages in the circumferential length and at least eight portrait printed pages in the longitudinal length, and the fourth printed page array is in the book format and comprises four landscape printed pages in the circumferential length and at least four landscape printed pages in the longitudinal length. The form cylinder further includes means for receiving a flexible printing plate in the circumferential direction and at least one flexible printing plate in the longitudinal direction. In addition, a circumference of the transfer cylinder is substantially equal to a circumference of the impression cylinder and an integral multiple of a circumference of the form cylinder.

The fact that the circumference of the transfer cylinder is larger than the form cylinder by an integral multiple permits the transfer cylinder to have a high degree of stiffness which also permits the form cylinder cooperating therewith to be effectively supported. The adjusting movement of the transfer cylinder to an impression throw-off position for an on the fly change of a printing plate is designed to be relatively large. It is possible for the bearing of the transfer cylinder, including its journals, to be of a large dimension which is particularly stable. On the other hand, the small diameter of the form cylinder creates a larger operating space between two double printing units, which can be encapsulated against noise more effectively with respect to the printing units. The larger operating space also increases the accessibility for mounting a device for automatically changing the printing forms and/or a device for washing the blanket.

In one embodiment, a plurality of blankets are arranged on the transfer cylinder in the longitudinal direction of the transfer cylinder. Slots or channels for fastening the ends of the blankets may be arranged offset with respect to one another in the circumferential direction of the transfer cylinder—preferably by 180° in the case of two blankets.

Given the use of the known possibilities of folding and cutting a printing material web in the longitudinal and transverse directions and of turning the printing material web or its partial webs after the printing material web has been printed, a double printing unit equipped according to the invention may be used to produce in an advantageously staged fashion in broadsheet format two printed pages, of variable products, arranged in portrait fashion on the form cylinder. This double printing unit has twice the capacity of printed pages with respect to a double printing unit having form cylinders which can be fitted in the circumferential direction with one printed page (once round), and in the longitudinal direction with two printed pages (single width). In the case, for example, of a product having eight printed pages in broadsheet format in a set, there is a need, depending on the desired coloring of the printed pages, for double the number of double printing units equipped with once-round and single-width form cylinders, and for an additional reel changer by comparison with the double printing unit according to the invention.

In a double printing unit equipped with doubly round (two printed pages in the circumferential direction) and single-width form cylinders, when full use is made of the page capacity production can be varied only in a stage of four printed pages, and the maximum printed page capacity can be used only in two sets. In contrast, production in the double printing unit according to the invention can be varied in one set in a stage of two printed pages in conjunction with maximum printed page capacity. On the other hand, the double printing unit according to the invention is also capable of implementing the other production possibilities of a double printing unit fitted with double-round and single-width form cylinders, that is to say double production (two products) with delivery via two folders and/or one product from two sets by one folder. On the basis of the capacity of eight printed pages in broadsheet format, a printing unit with double-round and single-width form cylinders is laid down with respect to the number of printed pages for the two forms of production, it being the case that for double production the same number of printed pages is always present in the two products, and for collect-run production the product comprises two sets with the same number of printed pages in the individual sets. In contrast, in the printing unit according to the invention variations are possible both in the number of printed pages in the two products for double production, and in the number of printed pages in the two sets of one product. Depending on the desired coloring, in the case, for example, of a product having eight printed pages in broadsheet format in one set, there is a need, by comparison with the double printing unit according to the invention, for twice the number of double printing units fitted with double-round and single-width form cylinders.

In the case of a double printing unit equipped with double-round and double-width (four printed pages in the longitudinal direction) form cylinders, the products can also be varied in a stage of two printed pages in a fashion similar to the printing unit according to the invention in the case of non-collect-run production, but only in a stage of four printed pages in the case of collect-run production. The full capacity of the possible printed pages of this printing unit can be implemented only in a product having two sets. In the case of a target product of eight printed pages in one set, the number of printing units according to the invention, which are technically less complicated, is equal to the number of printing units equipped with double-round and double-width form cylinders.

For further typical forms of production, it is also possible to arrange on the form cylinders of the printing unit according to the invention, which cylinders can be fitted in each case with four portrait printed pages in broadsheet format, eight landscape printed pages in tabloid format (two printed pages in the circumferential direction and four printed pages in the longitudinal direction) or sixteen portrait printed pages in book format (two printed pages in the circumferential direction and eight printed pages in the longitudinal direction) or eight landscape printed pages in book format (four printed pages in the circumferential direction and in the longitudinal direction).

Because of the fact that the form cylinder can be designed with a high degree of stiffness in a lightweight fashion, is supported against the transfer cylinder, which is several times larger, preferably twice as large, in circumference, and can therefore be operated at a high number of revolutions of, for example, 80,000 per hour, the double printing unit according to the invention can be used to achieve a level of production corresponding to the double printing unit conventionally equipped with form cylinders which can respectively be fitted in broadsheet format with two portrait printed pages in the circumferential direction and four portrait printed pages in the longitudinal direction.

In addition to the described preferred embodiment, which is designed for eight printed pages, of a double printing unit according to the invention, it is also possible to implement printing units which have in the longitudinal direction form cylinders which can be fitted with more than four portrait printed pages in broadsheet format.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is explained in more detail below with reference to exemplary embodiments. In the associated drawings:

FIG. 25 shows a form cylinder of the double printing unit according to FIG. 1 fitted with sixteen landscape printed pages in book format for producing a single-set product subsequent to the printing operation;

FIG. 26 shows the product of FIG. 25, which comprises a set of thirty-two printed pages;

FIG. 27 shows the form cylinder of FIG. 25 for producing two products of respectively one set subsequent to the printing operation; and FIG. 28 shows the product of FIG. 27, which comprises a set of sixteen printed pages.

DETAILED DESCRIPTION OF THE PRESENTLY PREFERRED EMBODIMENTS

Figure 1:
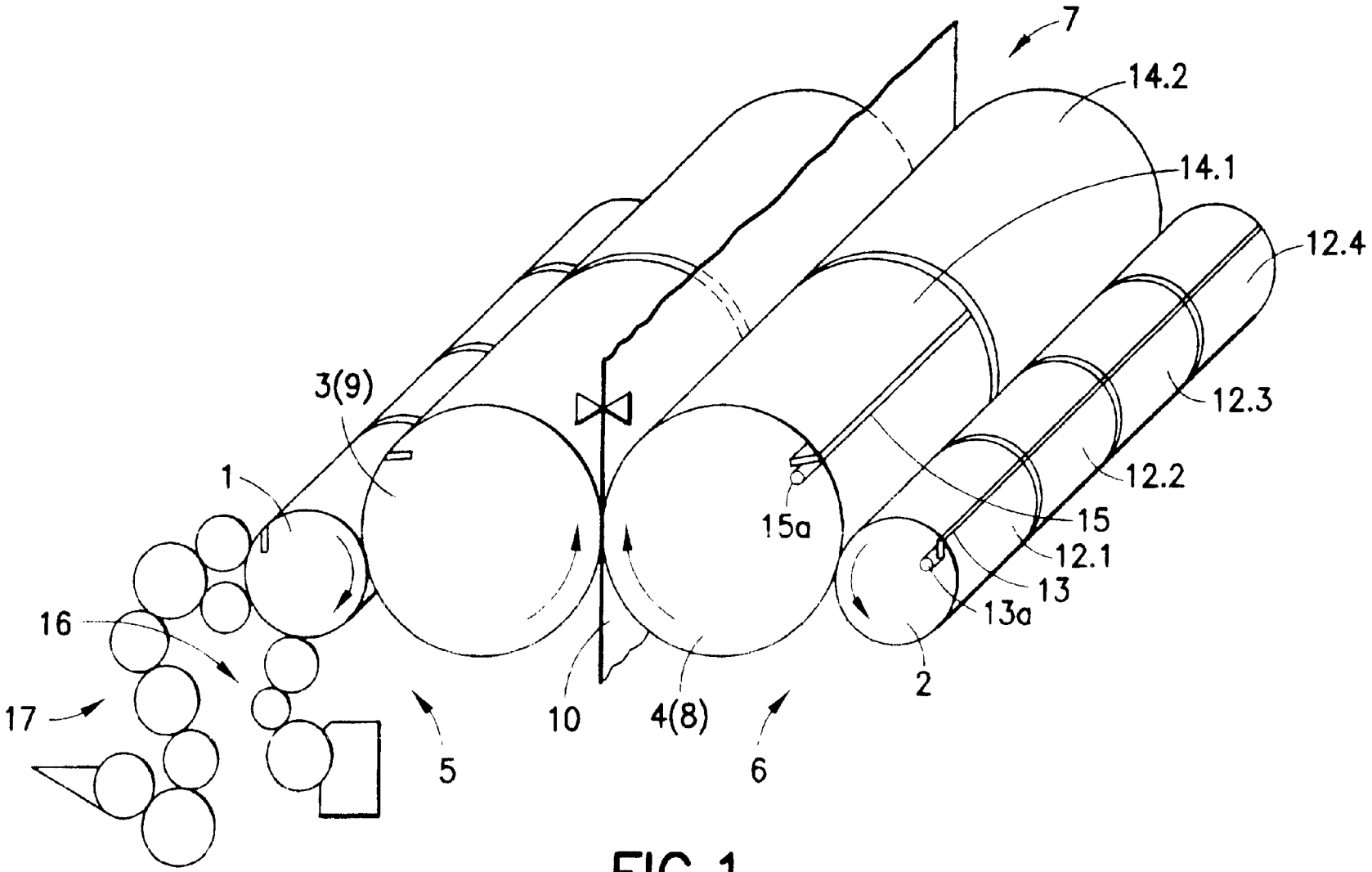
FIG. 1 shows a double printing unit according to an embodiment of the invention.

A double printing unit 7 according to an embodiment of the present invention is shown in FIG. 1. The double printing unit 7 includes two cylinder pairs 5, 6. Each of the two cylinder pairs 5, 6 includes a form cylinder 1, 2 and a transfer cylinder 3, 4. The transfer cylinder 3 functions as an impression cylinder (9) for the transfer cylinder 4 and the transfer cylinder 4 functions as an impression cylinder (8) for the transfer cylinder 3 for applying ink to both sides of a printing material web 10 which is guided between the two transfer cylinders 3, 4.

Figure 11:
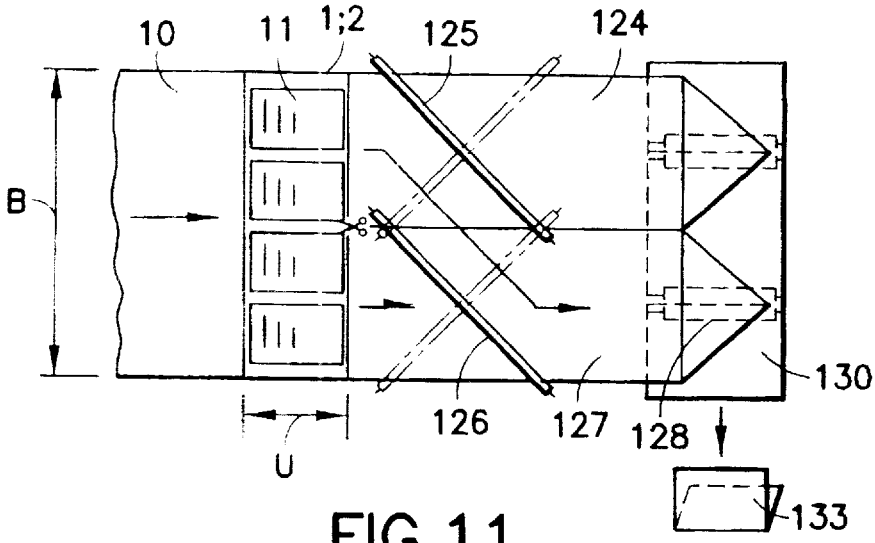
FIG. 11 shows a form cylinder of the double printing unit of FIG. 1 fitted with four portrait printed pages in broadsheet format for producing a single-set product subsequent to the printing operation.
Figure 13:
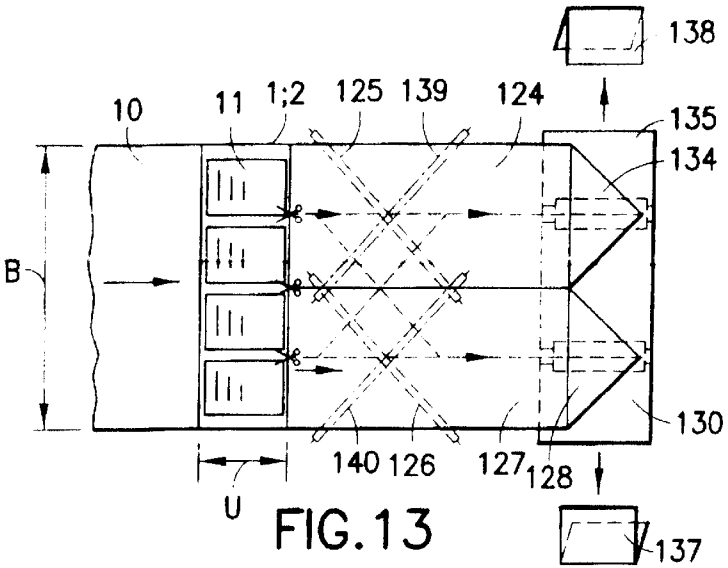
FIG. 13 shows the form cylinder of FIG. 11 for producing two products of respectively one set subsequent to the printing operation.
Figure 15:
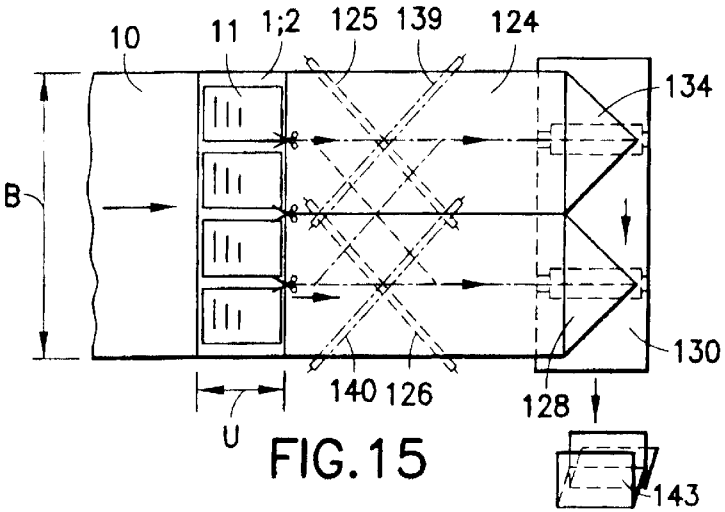
FIG. 15 shows the form cylinder of FIG. 11, for producing a two-set product subsequent to the printing operation.

Referring also to FIGS. 11, 13, and 15, the circumference of the form cylinders 1, 2 has a length U for receiving flexible printing plates 12.1 to 12.4, each capable of holding a portrait printed page 11 in broad sheet format. Each of the flexible printing plates 12.1 to 12.4 has bent edges (not shown) that are insertable into a longitudinal slot 13 on the form cylinder 1, 2 for holding the flexible printing plates 12.1 to 12.4 on the form cylinders 1, 2. The bent edges of the flexible printing plates 12.1 to 12.4 may be additionally secured in the slot 13 using a securing device 13a comprising a spring activated pressure means or a centrifugal force acting means that is active during operation of the printing unit 7. The securing of the bent edges may be further effected by inclining the slot 13 such that the opening of the slot 13 on the circumference of the form cylinder 1, 2 is inclined in the direction of rotation of the form cylinder 1, 2.

As shown in the FIGS. 11, 13, and 15, the length of the form cylinders 1, 2 is dimensioned for holding four portrait printed pages in broad sheet format. One printed page or a plurality of printed pages 11 may be arranged on a printing plate, depending on the particular product being produced. Each of the printing plates 12.1 to 12.4 is easily circumferentially mounted on the form cylinder 1, 2 and may be individually exchanged according to the embodiment shown in FIG. 1.

The transfer cylinder 3, 4 in each cylinder pair 5, 6 has double the circumferential length of the respective form cylinder 1, 2. Each transfer cylinder 3, 4 is covered with two blankets 14.1, 14.2 positioned longitudinally alongside each other. The two circumferential ends of each blanket 14.1, 14.2 may be stretched and secured in an axially parallel channel on the circumference of the transfer cylinder 3, 4. As an alternative, the blankets 14.1 and 14.2 may be fastened on a carrier plate (not shown in FIG. 1) having ends with bent edges which are inserted in a slot 15 on the circumference of the transfer cylinder 3, 4. If appropriate, the bent edges may be additionally fixed against slipping out of the slot by a securing device 15*a* comprising a spring activated pressure means or a centrifugal force acting means that is active during operation. Because of the larger diameter of the transfer cylinders 3, 4, the slots 15 for securing each of the blankets 14.1, 14.2 may be mutually offset by 180 degrees to improve the vibratory behavior of the double printing unit 7 (in FIG. 1, only the slot 15 for the front blanket 14.1 is visible).

As shown on the left-hand cylinder pair 5 in FIG. 1, the printing plates of the form cylinder 1 are first damped by a damping unit 16 and subsequently inked by an inking unit 17. Although not shown in FIG. 1, the damping unit 16 and the inking unit 17 are present in each of the cylinder pairs 5 and 6. As an alternative, the printing unit 7 may be operated as a dry offset printing unit or the ink of the inking unit 17 may contain a damping mixture as an admixture, thereby eliminating the requirement for a damping unit 16.

Instead of finite blankets 14.1, 14.2, the transfer cylinders 3, 4 may also be designed without a slot for receiving blanket sleeves which can be pushed in the axial direction onto the circumference by means of an air cushion. However, for this embodiment, the transfer cylinder 3, 4 must be releasable for changing the blanket sleeve on one side of its bearing in the machine frame.

Figure 2:
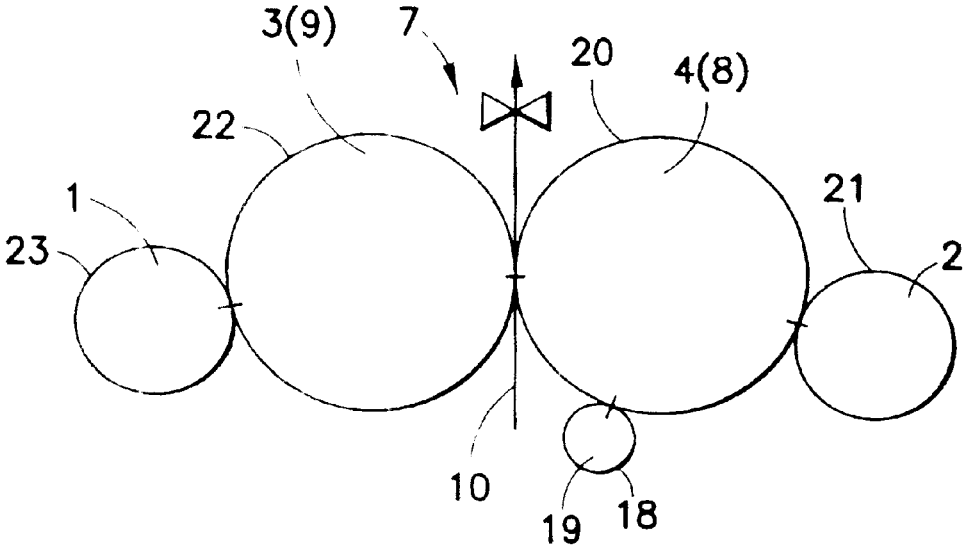
FIG. 2 shows an embodiment of a drive for the double printing unit FIG. 1.

FIG. 2 shows an individual drive for the double printing unit 7 including a coaxial drive pinion 18 and a motor 19. The respective drive connection is marked by a connecting stroke. The coaxial drive pinion 18 engages a cylinder drive wheel 20 of the transfer cylinder 4, which is rotatably mounted in a stationary location in the machine frame. The cylinder drive wheel 20 is drivably connected to both a cylinder drive wheel 21 of the form cylinder 2 and to a cylinder drive wheel 22 of the other transfer cylinder 3. The cylinder drive wheel 22, in turn, engages a cylinder drive wheel 23 of the form cylinder 1.

Figure 3:
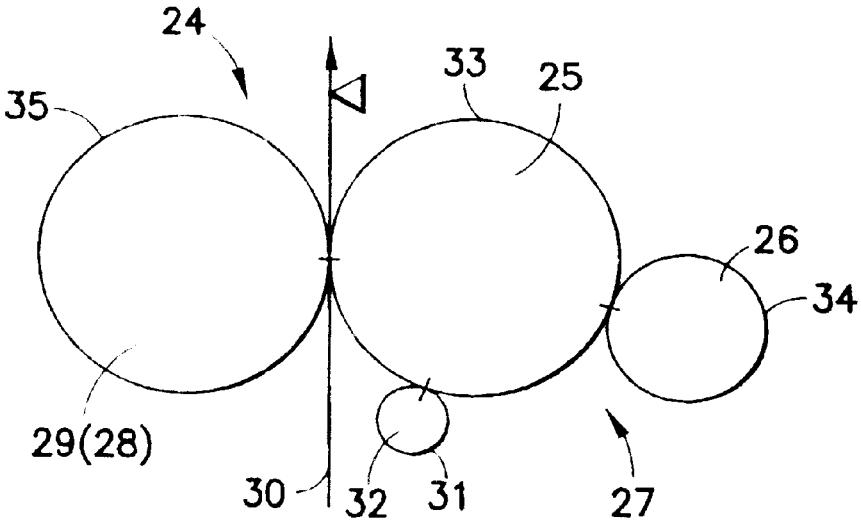
FIG. 3 shows another embodiment of a drive for a three-cylinder printing unit according to the invention.

FIG. 3 shows an embodiment of a three-cylinder printing unit 24 having a cylinder pair 27 including a transfer cylinder 25 and a form cylinder 26. The transfer cylinder 25 cooperates with a counterpressure cylinder 29 of equal circumference for applying ink to one side of a printing material web 30 guided between the transfer cylinder 25 and the counterpressure cylinder 29. The counterpressure cylinder 29 functions as an impression cylinder 28. The drive for the printing unit 24, similar to the printing unit 7 of FIG. 2, includes a motor 31 for driving a cylinder drive wheel 33 of the transfer cylinder 25 via a drive pinion 32. The cylinder drive wheel 33, in turn, drives a cylinder drive wheel 34 of the form cylinder 26 and a cylinder drive wheel 35 of the counterpressure cylinder 29.

Figure 4:
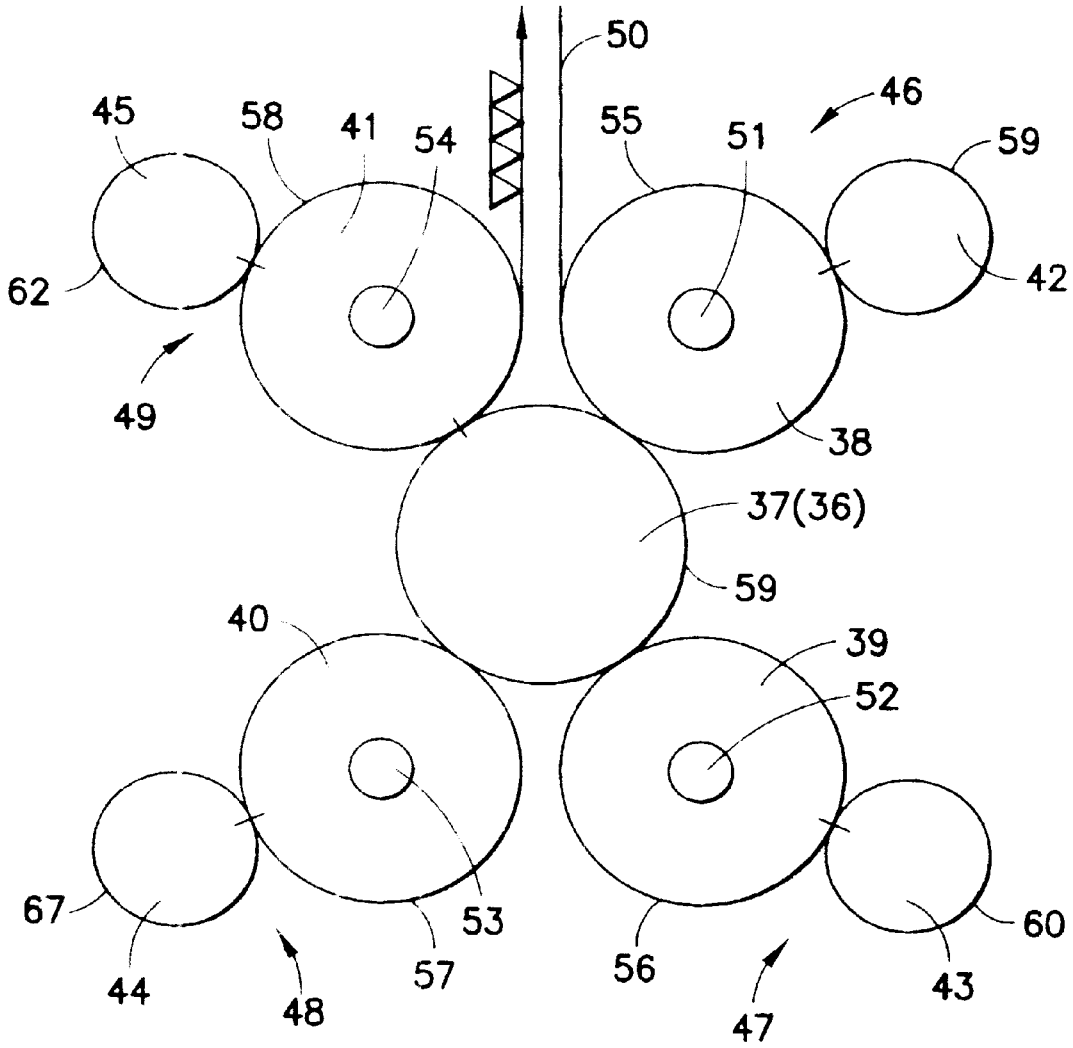
FIG. 4 shows a drive for an embodiment of a printing unit according to the invention having a satellite cylinder.

FIG. 4 shows a printing unit having a satellite cylinder 37 that functions as an impression cylinder 36 for transfer cylinders 38 to 41 of cylinder pairs 46 to 49. Each of the cylinder pairs 46 to 49 comprises a form cylinder 42 to 45 for each respective one of the transfer cylinders 38 to 41. A printing material web 50 wraps around the satellite cylinder 37 for receiving an application of ink on one side of the printing material web 50 in sequence from each of the four transfer cylinders 38 to 41.

Each of the transfer cylinders 38 to 41 is directly driven by a respective coaxially mounted motor 51 to 54. Cylinder drive wheels 55 to 58 of the transfer cylinders 38 to 41 engage cylinder drive wheels 59 to 62 of associated form cylinders 42 to 45. The cylinder drive wheel 58 of the transfer cylinder 41 additionally drives a cylinder drive wheel 59 of the satellite cylinder 37.

Figure 5:
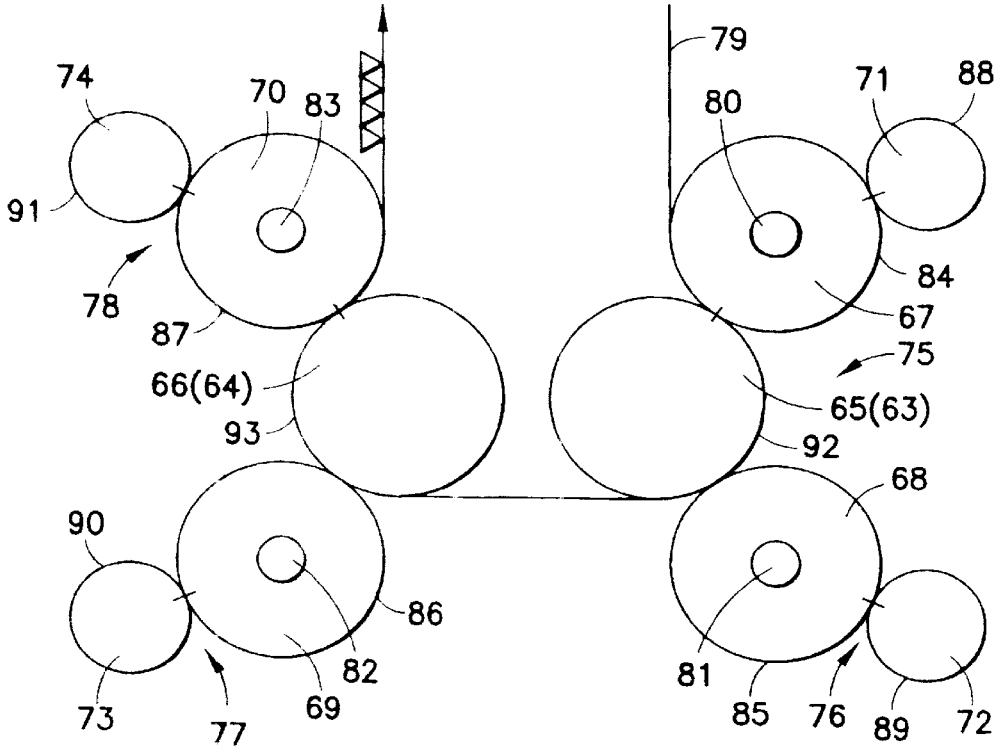
FIG. 5 shows a drive for an embodiment of a printing unit according to the invention having two satellite cylinders.

FIG. 5 shows a printing unit having two satellite cylinders 65, 66. The satellite cylinder 65 functions as an impression cylinder 63 for two transfer cylinders 67, 68 of respective cylinder pairs 75, 76 and the satellite cylinder 66 functions as an impression cylinder 64 for two transfer cylinders 69, 70 of respective cylinder pairs 77, 78. Each of the cylinder pairs 75 to 78 comprises a form cylinder 71 to 74 in operative arrangement with the respective one of transfer cylinders 67 to 70. A printing material web 79 wraps around the two satellite cylinders 65, 66 sequentially respectively having ink applied to it on the same side in sequence at two printing positions on each of the satellite cylinders 65, 66.

Each transfer cylinder 67 to 70 is driven directly by a coaxially mounted motor 80 to 83. Cylinder drive wheels 84 to 87 of the respective transfer cylinders 67 to 70 engage cylinder drive wheels 88 to 91 of the associated form cylinders 71 to 74. A cylinder drive wheel 92 of the satellite cylinder 65 is driven by the cylinder drive wheel 84 of the transfer cylinder 67 and a cylinder wheel 93 of the satellite cylinder 66 is driven by the cylinder drive wheel 87 of the transfer cylinder 70.

Figure 6:
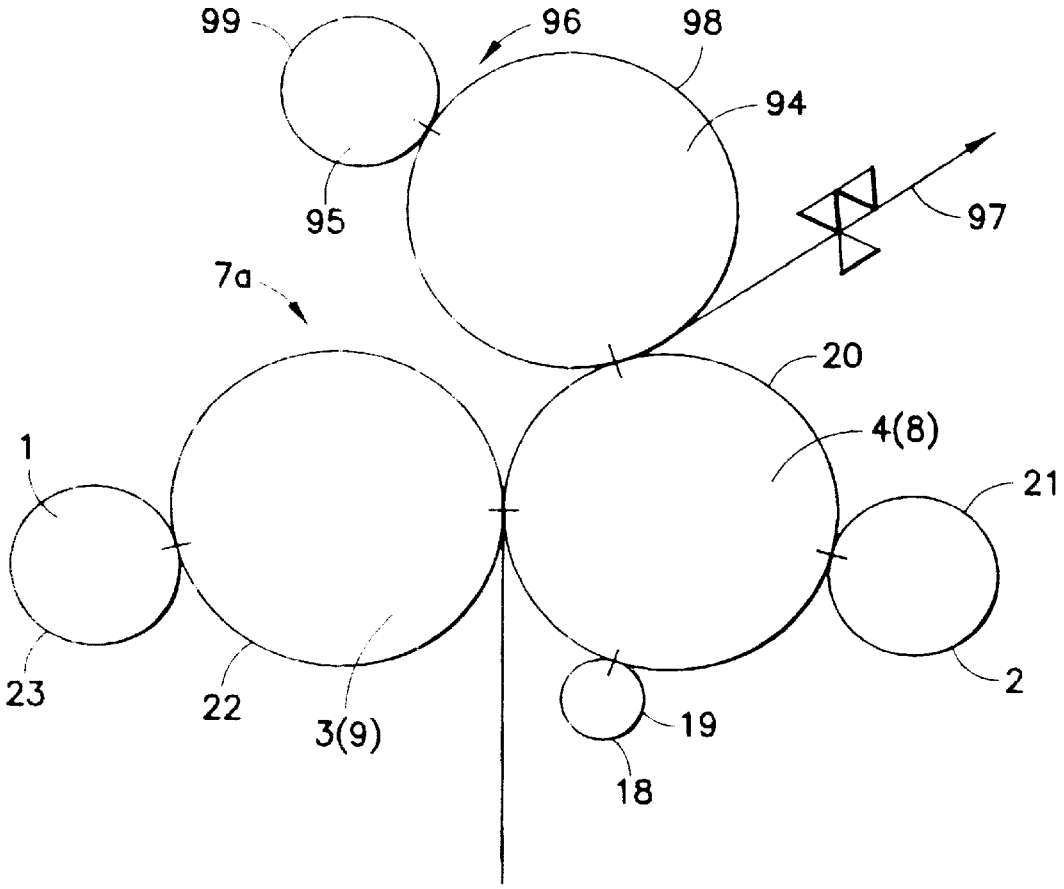
FIG. 6 shows a drive for a Y printing unit according to an embodiment of the invention.

FIG. 6 shows a double printing unit 7a which is similar in configuration to the printing units shown in FIGS. 1 and 2 but is expanded to form a Y printing unit by the addition of a cylinder pair 96 comprising a transfer cylinder 94 and a form cylinder 95. The transfer cylinder 94 cooperates with the transfer cylinder 4, which is mounted in a stationary fashion in the machine frame, so that an additional application of ink is applied to one side of a printing material web 97. That is, one side of the printing material web receives two applications of ink from transfer cylinders 3 and 94 and the other side of the printing material web receives one application of ink from the transfer cylinder 4.

To drive the cylinder pair 96, a cylinder drive wheel 98 of the transfer cylinder 94 is in driving engagement with the cylinder drive wheel 20 of the transfer cylinder 4. The cylinder drive wheel 98 also engages a cylinder drive wheel 99 of the associated form cylinder 95.

Figure 7:
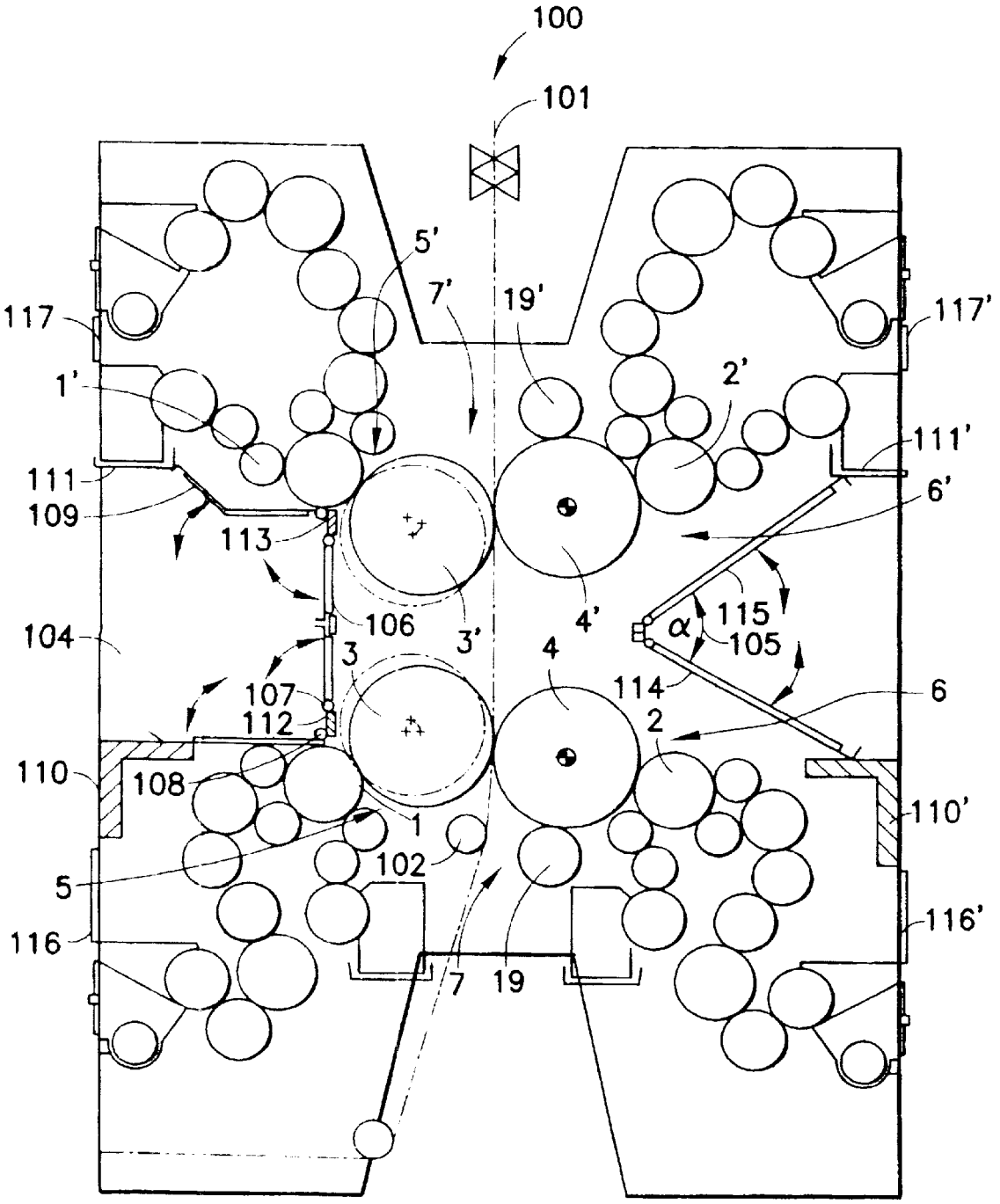
FIG. 7 shows a print unit assembled from two double printing units according to an embodiment of the invention having vertical web guidance.

FIG. 7 shows a print unit 100 having two double printing units 7, 7' arranged one above the other which apply up to two inks to each side of a vertically guided printing material web 101. The representation illustrates that the small diameter of the form cylinders 1, 1', 2, 2' leads to a gain in space between the double printing units 7, 7' which is useful for an improved operation and the additional installation of devices for washing the blankets and/or automatically changing the printing plates.

Figure 8:
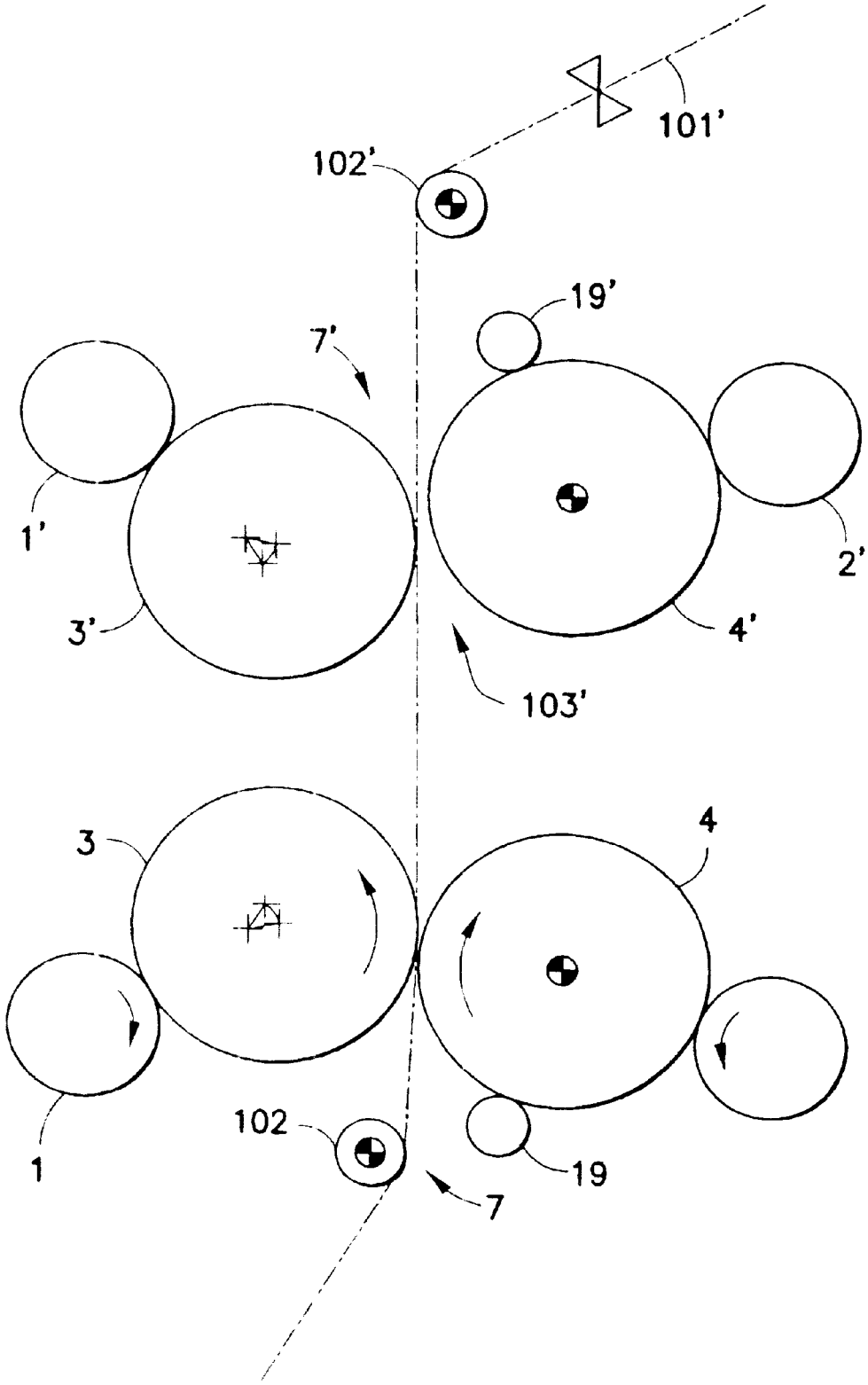
FIG. 8 shows the course of the web in the print unit according to FIG. 7 when the lower double printing unit is in printing operation and the upper double printing unit is in a thrown out position allowing an on the fly change of a printing plate.
Figure 9:
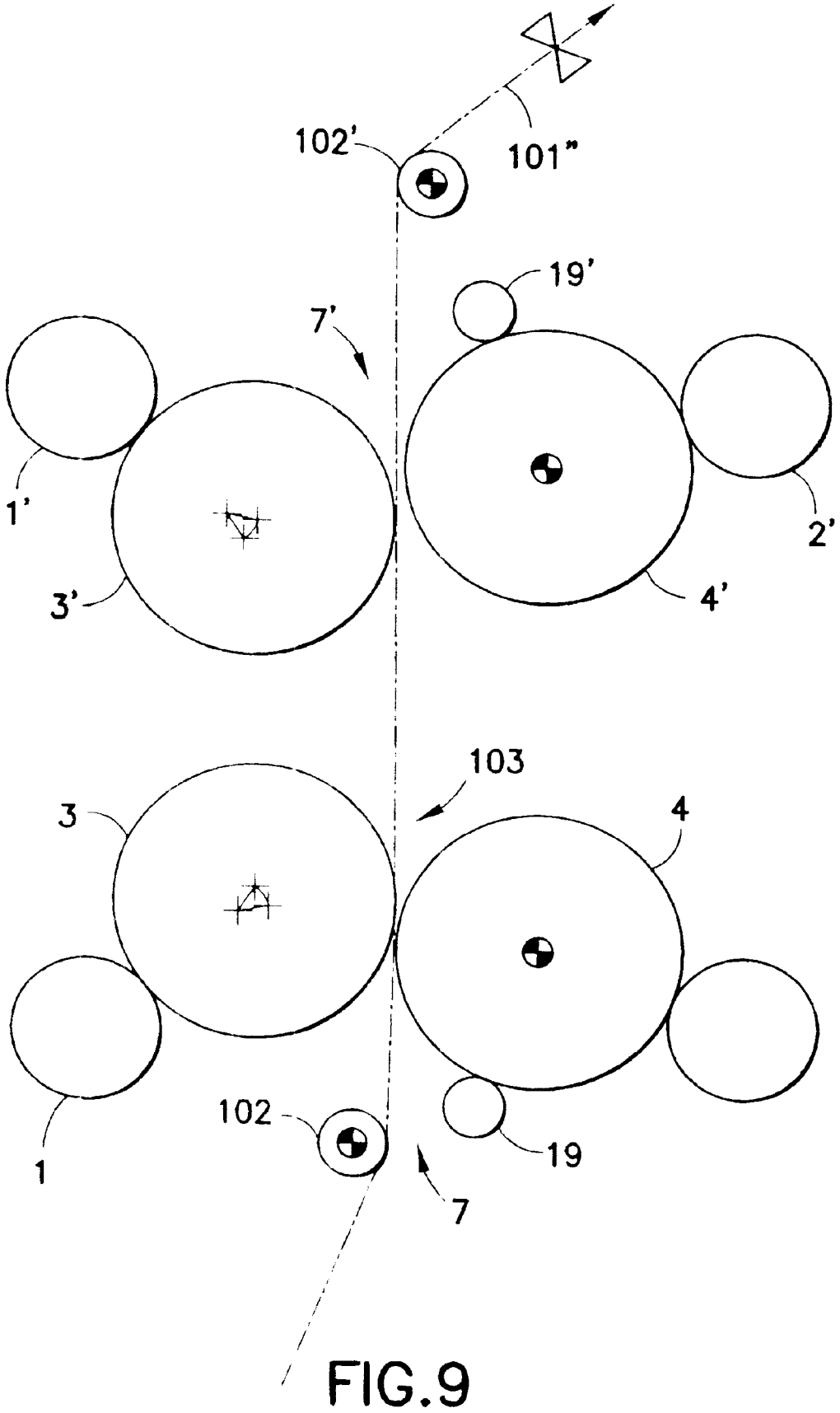
FIG. 9 shows the course of the web in the print unit according to FIG. 7 when the upper double printing unit is in printing operation and the lower double printing unit is in a thrown out position allowing an on the fly change of a printing plate.

On the other hand, the transfer cylinder 3, 3', 4, 4', which is twice as large in diameter, provides a stable support for the smaller form cylinders 1, 1', 2, 2'. The large size of the transfer cylinders ensures functionally reliable bearing of the transfer cylinder 3, 3' and permits a correspondingly large eccentric for allowing the cylinder to be swivelled away for an on the fly change of a printing plate. FIGS. 8 and 9 show the appropriate cylinder positions for this purpose. In FIG. 8, the transfer cylinders 3, 4 of the lower double printing unit 7 are located in the printing position (impression throw-on position) with the left-hand transfer cylinder 3 pivoted on. The transfer cylinders 3', 4' of the upper double printing unit 7' are located in the impression throw-off position, which permits an on the fly change of the printing plate, with the left-hand transfer cylinder 3' pivoted away. FIG. 9 shows the lower transfer cylinders 3, 4 located in the impression throw-off position and the upper transfer cylinders 3', 4' located in the printing position. In both FIG. 8 and in FIG. 9, the printing material web 101' and 101", respectively, has only one ink applied to both sides. A roller 102 is arranged on the upstream of the lower double printing unit 7 and another roller 102' is arranged downstream of the upper double printing unit 7' in the web travel direction. The printing material web 101' and 101" is guided by these rollers 102 and 102' so that the printing material web 101' of FIG. 8 passes through the gap 103' between transfer cylinders 3', 4' without contacting either of the transfer cylinders 3', 4' and so that the printing material web 101" of FIG. 9 passes through the gap 103 between the transfer cylinders 3, 4 without contacting either of the transfer cylinders 3, 4.

Referring again to FIG. 7, the large space existing between the double printing units 7 and 7' allows an operating space 104, 105 to be favorably encapsulated for reducing the sound emissions of the printing units 7, 7'. Two embodiments for effecting the reduction in sound emission are shown in FIG. 7. In the first embodiment shown on the left-hand side of FIG. 7, two guards 106 and 107 are vertically situated one above the other. The upper end of the upper guard 106 and the lower end of the lower guard 107 horizontally adjoin guards 108 and 109, respectively. A cross bar 110 or a damping unit cladding 111 form a coherent surface from the ends of guards 108 and 109 to the outside of the print unit 100.

The guards 106 to 109 extend in each case over the full width between the walls of the print unit 100 and are in each case mounted such that they swivel on a transverse support 112, located between guards 106 and 109 and a transverse support 113, located between guards 107 and 108. The transverse supports 112 and 113 are fixed to the frame into 15 the operating space 104 in an axially parallel fashion relative to the transfer cylinders 3, 3'.

In the other embodiment shown between the two right-hand cylinder pairs 6, 6', two guards 114, 115 are arranged at an angle $\alpha$ relative to one another between the two right-hand cylinder pairs 6, 6'. These guards 114 and 115 likewise form with a crossbar 110' and a damping unit cladding 111' a coherent surface up to the outside of the print unit 100. The guards 114; 115 are mounted in the region of the apex of the angle $\alpha$ on a transverse support fixed to the frame of the print unit 100 such that they can swivel into the operating space 105, and likewise extend over the full width between the walls of the print unit 100.

By appropriately swivelling the guards 106 to 109 or 114, 115 into the respective operating space 104 or 105, access to the respective cylinder or cylinder pair of the double printing units 7, 7' is ensured for facilitating an on the fly change of the printing plate on one double printing unit. In addition, access to the cylinders of the other double printing unit, which is in the operating state, is blocked in each case.

The guards 106 to 109 and 114, 115 may also be designed in a multipartite, multiple foldable fashion with pivotably connected surface elements.

To provide effective soundproofing on the print unit 100 of FIG. 7, openings arranged on its outside for operating and servicing are closed by removable guards 116, 116', 117, 117'. The decoupled operating space 104, 105 between the double printing units 7, 7' and the removable guards 116, 116', 117, 117' together produce a closed soundproof cladding of the print unit 100.

Figure 10:
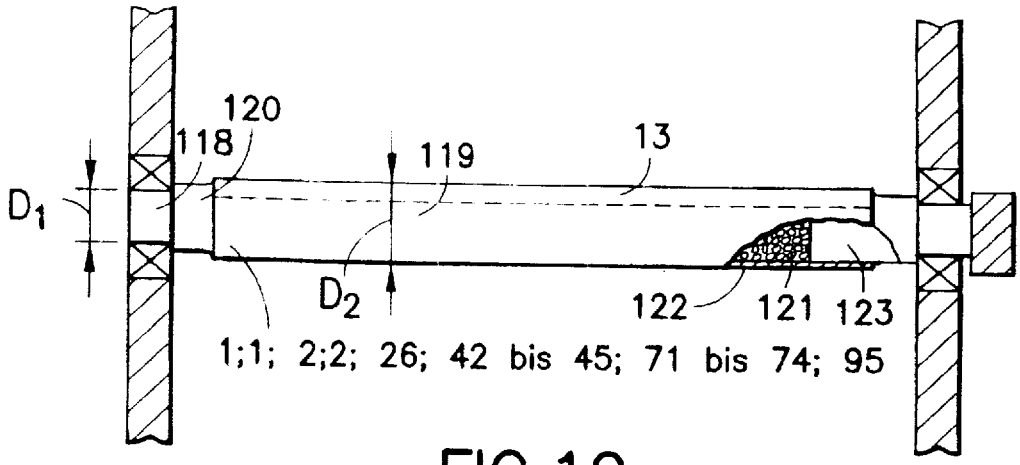
FIG. 10 is a schematic diagram of an embodiment of a form cylinder according to the present invention.

FIG. 10 shows a diagram of a form cylinder 1 which may be used as any of the form cylinders 1, 1', 2, 2', 26, 42 to 45, 71 to 74, or 95. The form cylinder 1 has a stable bearing whose diameter $D_1$ at a bearing point 118 is at least ⅔ of the diameter $D_2$ of its cylinder body 119. The slot 13 for receiving the edges of the printing plates 12.1 to 12.4 (FIG. 1) ends in each case in a collar 120 on the side of the cylinder body 119. To ensure a lightweight design in conjunction with a high degree of stiffness, the cylinder body 119 may comprise a composite design instead of a solid design in accordance with the embodiment shown in FIG. 10. A steel tube 122 is filled with a foamed metal 121 and into which laterally separated bearing journals 123 are inserted to the open ends of the steel tube 122. In addition to reducing weight in conjunction with the high degree of stiffness owing to the composite design, the foamed metal 121 additionally acts to damp vibrations on the form cylinder. It is also conceivable to design the cylinder body 119 from a carbon fiber material or to incorporate carbon fiber material into the cylinder body 119 in conjunction with another material.

FIGS. 11 to 16 show the use of the double printing unit 7 in accordance with FIG. 1 for producing different types of products in broadsheet format. The form cylinder 1, 2 is circumferentially fitted with four portrait printed pages 11 in broadsheet format. FIGS. 11, 13, 15 respectively show the developed circumference U for this purpose. By using the full web width B of the printing material web 10, four printed pages on each side of the printing material web 10 or eight total printed pages, are printed at a printing point in the double printing unit 7 of FIG. 1.

Figure 12:
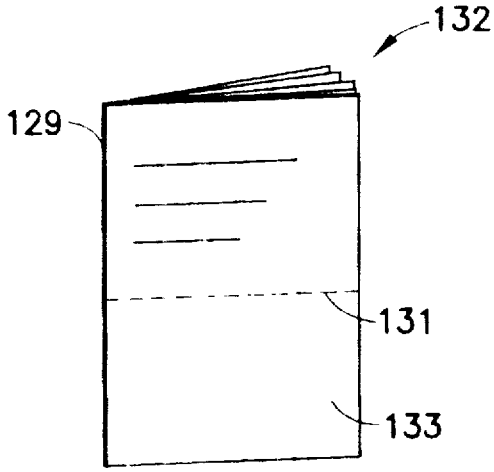
FIG. 12 shows the product of FIG. 11, which comprises a set of eight printed pages.

In the embodiment of FIGS. 11 and 12, after the printing operation the printing material web 10 is cut longitudinally in the middle into an upper partial web 124 and a lower partial web 127. After the cutting operation, turner bars 125, 126 turn the upper partial web 124 over the lower partial web 127. A former 128 then folds the upper and lower partial webs 124, 127 along a longitudinal fold 129 and a folder 130 subsequently creates a crossfold 131, and are designed as a product 133 comprising a set 132 of eight printed pages.

Of course, the double printing unit 7 may also be used for printing material webs with a web width corresponding to three or two portrait printed pages 11 or one portrait printed page 11 for the purpose of producing a product in broadsheet format which comprises a set of six, four, or two printed pages.

Figure 14:
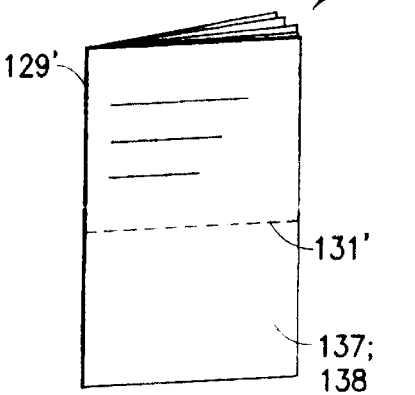
FIG. 14 shows the product of FIG. 13, which comprises a set of four printed pages.

Instead of directing the upper and lower partial webs 124, 127 to one former 130, FIG. 13 shows that the upper and lower partial webs 124, 127 are run in separate formers 128, 134. In this embodiment, the upper and lower partial webs 124 and 127 are designed as separate products 137, 138, each comprising one set 136 of four printed pages by separate folders 130, 135. The folders 130, 135 may be combined in one double folder. FIG. 14 shows the resulting separate products 137, 138 of the printing unit of FIG. 13.

FIG. 13 additionally shows that the upper and lower partial webs 124 and 127 may be cut open in the middle in the longitudinal direction in accordance with the dashed line. In this case, a product with a set of two printed pages and a product with a set of six printed pages may be produced in each case by using the turner bars 125, 126 and 139, 140 in the direction of the hollow arrows. If the web width corresponds only to three portrait printed pages 11 instead of four, two products may be produced in broadsheet format with a set of four printed pages in one product and a set of two printed pages in the other product.

Figure 16:
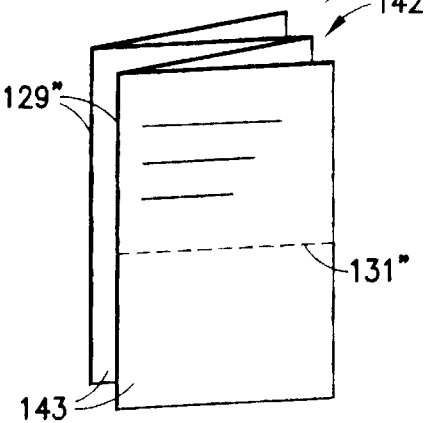
FIG. 16 shows the product of FIG. 15, which comprises two set of four printed pages.

FIGS. 15 and 16 show the configuration for producing a product 143 in broadsheet format comprising two sets 141, 142. Each of the two sets 141, 142 has four printed pages (see FIG. 16). In this embodiment, the upper and lower partial webs 124, 127 are fed to a folder 130 after being brought together situated one behind another downstream of the formers 128, 134.

However, instead of cutting the paper web 10 in the middle, a product with two printed pages in one set and six printed pages in the other set may be produced by cutting the upper partial web 124 or the lower partial web 127 longitudinally in the middle and making use of the turner bars 125, 126 and 139, 140.

A printing material web with a web width corresponding to three portrait printed pages may be used to produce a product with four printed pages in one set and two printed pages in the other set.

It follows from the explanations so far that the double printing unit according to FIG. 1 may be used to produce in one stage two printed pages 11, arranged in portrait fashion on the form cylinder 1, 2, of variable products in broadsheet format.

FIGS. 17 to 20 show the use of the double printing unit 7 in accordance with FIG. 1 to produce different products in tabloid format. In this case, the form cylinder 1, 2 is circumferentially fitted with two landscape printed pages 144, and in the longitudinal direction with four landscape printed pages 144 in tabloid format. By using the full web width B of the printing material web 10, eight printed pages on each side of the printing material web 10, or sixteen pages are printed in the double printing unit 7 of FIG. 1.

Figure 18:
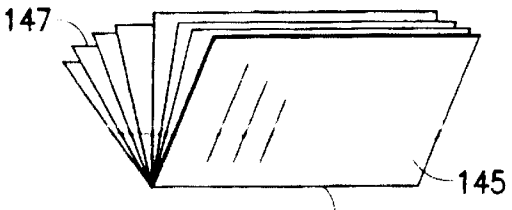
FIG. 18 shows the product of FIG. 17, which comprises a set of sixteen printed pages.
Figure 17:
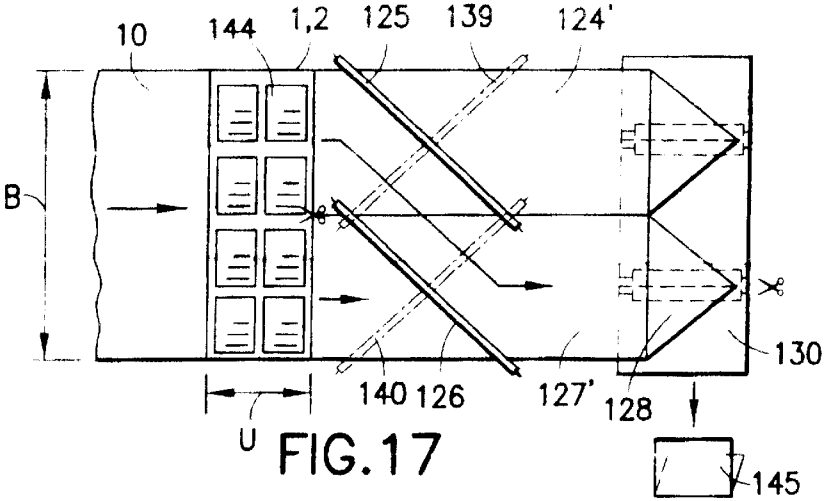
FIG. 17 shows a form cylinder of the double printing unit according to FIG. 1 fitted with eight landscape printed pages in tabloid format for producing a single-set product subsequent to the printing operation.

Similarly to the embodiment of FIG. 11, the embodiment of FIG. 17 turns the upper partial web 124' over the lower partial web 127'. The upper and lower partial webs 124' and 127' are cut open jointly in the middle via the former 128 and delivered by the folder 130 as a cross-folded product 145 comprising one set. FIG. 18 shows as a detail this product 145 comprising sixteen printed pages, in tabloid format with the cross fold 146 on the spine and the cut open longitudinal fold 147 on the side.

The double printing unit 7 of FIG. 1 can also be used for printing material webs with a web width corresponding to three or two landscape printed pages 144 or one landscape printed page 144 in order to produce a product in tabloid format comprising one set of pages with twelve, eight, or four printed pages 144 respectively.

Figure 20:
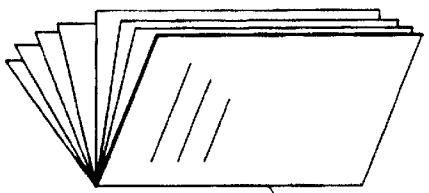
FIG. 20 shows the product of FIG. 19, which comprises a set of eight printed pages.
Figure 19:
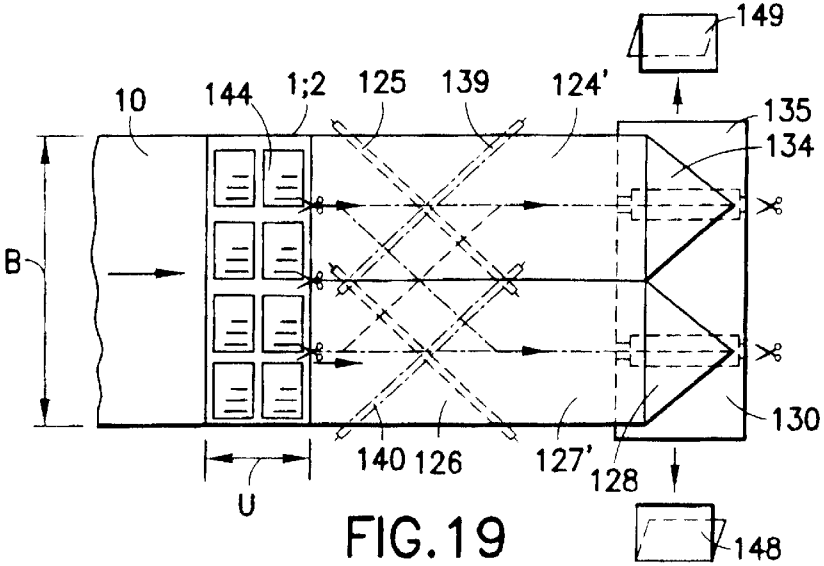
FIG. 19 shows the form cylinder of FIG. 17 for providing two products of respectively one set subsequent to the printing operation.

FIG. 19 shows that the upper and lower partial webs 124', 127' run over separate formers 128, 134. Each of the upper and lower partial webs 124' and 127' is cut open in the middle via the former 128, 134 and is then delivered by the respective folder 130, 135 as separate products 148, 149. FIG. 20 shows for this purpose as a detail the product 148, 149 in tabloid format comprising one set of eight printed pages 144.

FIG. 19 also shows that instead of cutting along the middle of the printing material web 10, the upper and lower partial webs 124', 127' may additionally be cut open in the middle in the longitudinal direction in accordance with the dashed line, with the result that a product with four printed pages 144 and a product with twelve printed pages 144 can be produced in each case by using the turner bars 125, 126 and 139, 140 in the direction of the hollow arrows. If the web width is only equal to the width of three landscape printed pages 144, two products may be produced in tabloid format with a set of four printed pages 144 in one product and a set of eight printed pages 144 in the other product.

The double printing unit 7 according to FIG. 1 may be used to produce in one stage four printed pages 144, arranged in landscape fashion on the form cylinder 1, 2, of variable products in tabloid format.

FIGS. 21 to 24 show the use of the double printing unit 7 in accordance with FIG. 1 to produce different products in book format. The form cylinder 1, 2 is fitted in the circumferential direction with two portrait printed pages 150, and in the longitudinal direction with eight portrait printed pages 150 in book format. By using the full web width B of the printing material web 10, thirty-two printed pages, sixteen on each side of the printing material web 10, may be printed in the double printing unit 7 of FIG. 1.

Figure 21:
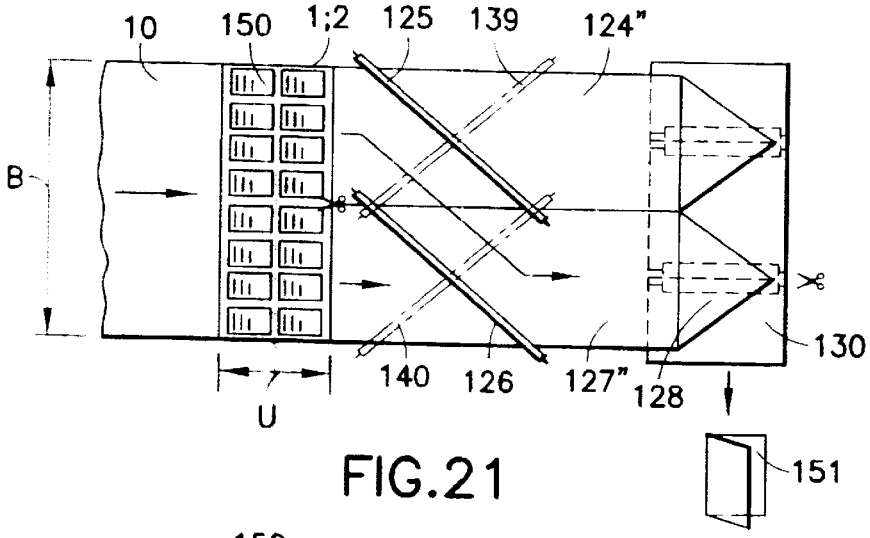
FIG. 21 shows a form cylinder of the double printing unit according to FIG. 1 fitted with sixteen portrait printed pages in book format for producing a single-set product subsequent to the printing operation.
Figure 22:
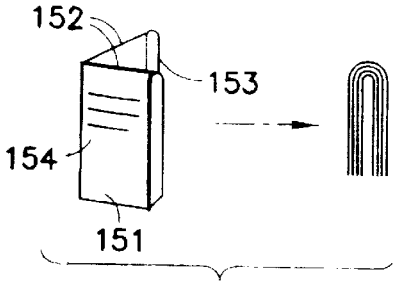
FIG. 22 shows the product of FIG. 21, which comprises a set of thirty-two printed pages.

Similarly to FIG. 17, the upper partial web 124" is turned over the lower partial web 127" in FIG. 21. The two partial webs 124" and 127" are cut open jointly in the middle via the former 128 and delivered by the folder 130 as a cross-folded product 151 comprising one set of pages and additionally provided with a second longitudinal fold. FIG. 22 shows as a detail this product 151 comprising thirty-two printed pages 150, in book format with the cross fold 152 uppermost, the cut-open first longitudinal fold 153 on one side and the second longitudinal fold 154 on the other side.

The double printing unit 7 of FIG. 1 may also be used for printing material webs with a web width corresponding to six or four or two portrait printed pages 150 in order to produce a product in book format comprising a set of twenty-four, sixteen, or eight printed pages respectively.

Figure 23:
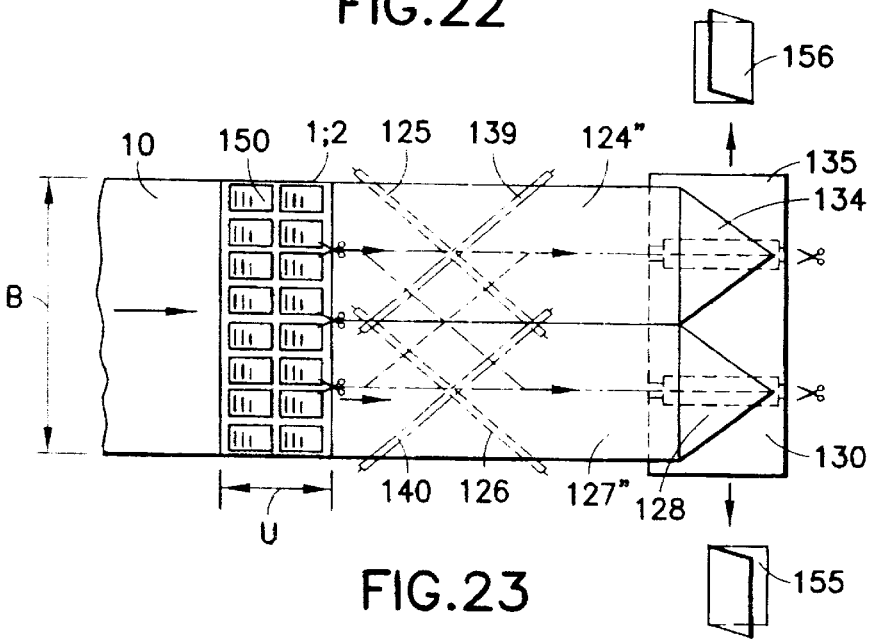
FIG. 23 shows the form cylinder of FIG. 21 for producing two products of respectively one set subsequent to the printing operation.
Figure 24:
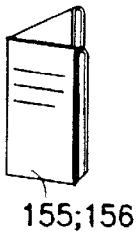
FIG. 24 shows the product of FIG. 23, which comprises a set of sixteen printed pages.

Instead of being run into one former, FIG. 23 shows that the upper and lower partial webs 124", 127" are run into separate formers 128, 134. Each of the upper and lower partial webs 124" and 127" cut open in the middle via the respective former 128, 134 and subsequently delivered by the respective folder 130, 135 as separate products 155, 156. FIG. 24 shows for this purpose as a detail the separate products 155, 156 in book format comprising one set of sixteen printed pages.

Instead of cutting the printing material web in the middle, FIG. 23 also shows that one of the partial webs 124", 127" may be cut open in the middle in the longitudinal direction in accordance with the dashed line, with the result that a product with a set of eight printed pages 150 and a product with a set of twenty-four printed pages 150 is produced by using the turner bars 125, 126 and 139, 140 in the direction of the hollow arrows. By contrast, if the web width corresponds only to six portrait printed pages 150, two single-set products may be produced in book format with a set of eight printed pages in one product and a set of sixteen printed pages in the other product.

The double printing unit 7 according to FIG. 1 can be used to produce in one stage eight printed pages 150, arranged in portrait fashion on the form cylinder 1, 2 of variable products in book format.

FIGS. 25 to 28 show the use of the double printing unit 7 according to with FIG. 7 to produce different products in book format. The form cylinder 1, 2 is fitted in the circumferential direction with four landscape printed pages 157, and in the longitudinal direction with four landscape printed pages 157 in book format. By using the full web width B of the printing material web 10, thirty-two printed pages, sixteen on each side, are printed on the material web in the double printing unit 7 of FIG. 1.

Similarly to FIG. 21, in FIG. 25 the upper partial web 124'" is turned over the lower partial web 127'". The upper and lower partial webs 124'", 127'" are cut open jointly in the middle in the longitudinal direction via the former 128 and delivered by the folder 130 as a product 158 comprising one set of pages additionally provided, apart from the first cross fold, with a second cross fold or parallel fold. FIG. 26 shows as a detail this product 158 comprising a set of thirty-two printed pages, in book format with the first cross fold 159 situated at the top on the front, with the cut-open first longitudinal fold 160 on the side and the second cross fold 161 below.

The double printing unit 7 of FIG. 1 may also be used for printing material webs with a web width corresponding to three or two landscape printed pages 157 or one portrait printed page 157 to produce a product in book format comprising a set of twenty-four, sixteen, or eight printed pages respectively.

Instead of one former, FIG. 27 shows that the upper and lower partial webs 124'", 127'" run in separate formers 128, 134. The upper and lower partial webs 124'", 127'" are cut open in the middle via the former 128, 134 and subsequently delivered by the respective folder 130, 135 as separate products 162, 163. FIG. 28 shows for this purpose as a detail the product 162, 163 in book format comprising a set of sixteen printed pages.

Instead of cutting the printing material web 10 in the middle, FIG. 27 shows that one of the upper and lower partial webs 124'", 127'" may be cut open in the longitudinal direction in accordance with the dashed line, with the result that a product with a set of eight printed pages 157 and a product with a set of twenty-four printed pages 157 may be produced in each case by using the turner bars 125, 126 and 138, 139 in the direction of the hollow arrows. By contrast, if the web width corresponds only to six portrait printed pages 157, two products may be produced in book format with a set of eight printed pages in one product and a set of sixteen printed pages in the other product.

The double printing unit 7 according to FIG. 1 may be used to produce in one stage four printed pages 157, arranged in landscape fashion on the form cylinder 1, 2, of variable products in book format.

The invention is not limited by the embodiments described above which are presented as examples only but can be modified in various ways within the scope of protection defined by the appended patent claims.

We claim:

1. A roll-fed rotary offset printing machine, comprising:

a printing unit having an impression cylinder and at least one cylinder pair including a form cylinder and a transfer cylinder operatively arranged so that ink is applicable from the transfer cylinder to a printing material web guidable along a vertical path between the transfer cylinder and the impression cylinder;

the form cylinder having an outer surface with a circumferential length and a longitudinal length configured such that a first print page array is independently fittable within the outer surface of the form cylinder, the first print page array being in a broadsheet format and comprising only one broadsheet page fittable in the circumferential length of the form cylinder and at least four broadsheet pages fittable in the longitudinal length of the form cylinder, wherein the circumferential length of said form cylinder is sized for receiving only one height of said broadsheet page; and said form cylinder further comprising means for receiving at least one flexible printing plate having a height and a length, wherein the circumferential length of said form cylinder is sized for receiving only one height of said at least one flexible printing plate and the longitudinal length of said form cylinder is sized for receiving at least one width of said at least one flexible printing plate, wherein said first print page array is arrangeable on said at least one flexible printing plate; and wherein a circumferential length of said transfer cylinder is larger than the circumferential length of said form cylinder by an integral multiple and a longitudinal length of said transfer cylinder spans at least the longitudinal length of said at least one flexible printing plate.

2. The offset printing machine of claim 1, wherein said at least one cylinder pair comprises first and second cylinder pairs respectively including first and second transfer cylinders and first and second form cylinders, said impression cylinder comprises said second transfer cylinder, and said first and second cylinder pairs are arranged on opposing sides of a printing material web path of the printing material web so that one ink is applicable simultaneously to the opposing sides of the printing material web guidable between said first and second transfer cylinders.

3. The offset printing machine of claim 1, wherein said printing unit comprises a double printing unit having two cylinder pairs, each said two cylinder pairs comprising a transfer cylinder and a form cylinder, said offset printing machine further comprising a drive motor operatively drivably connected to said transfer cylinder of one of said two cylinder pairs via a gearwheel wherein said transfer cylinders and said form cylinders of said two cylinder pairs are drivably connected to said gearwheel of said transfer cylinder.

4. The offset printing machine of claim 1, wherein said printing unit comprises a double printing unit operatively arranged for producing in one stage two printed pages in a portrait arrangement on said form cylinder of variable products in the broadsheet format.

5. The offset printing machine of claim 2, wherein said at least one flexible printing plate is interchangeable with at least another flexible printing plate for producing in one stage a product in broadsheet format having a set of one of eight, six, four, and two broadsheet pages using a printing material web having a web width respectively corresponding to one of four, three, two, or one broadsheet pages.

6. The offset printing machine of claim 2, wherein said at least one flexible printing plate is interchangeable with at least another flexible printing plate for producing in one stage a first and second product in broadsheet format, each said first and second products comprising one set of broadsheet pages;

said first product comprising a set of one of two broadsheet pages and four broadsheet pages and said second product comprising respectively a set of one of four broadsheet pages and six broadsheet pages when the printing material web comprises a web width corresponding to four broadsheet pages; and said first product comprising a set of two broadsheet pages and said second product comprising a set of four broadsheet pages when the printing material web comprises a web width corresponding to three broadsheet pages.

7. The offset printing machine of claim 2, wherein said at least one flexible printing plate is interchangeable with at least another flexible printing plate for producing in one stage a product in broadsheet format having first and second sets;

said first set comprising one of two broadsheet pages and four broadsheet pages and said second set respectively comprising one of six broadsheet pages and four broadsheet pages when the printing material web comprises a web width corresponding to four broadsheet pages; and said first set comprising four broadsheet pages and said second set comprising two broadsheet pages when said printing materal web comprises a web width corresponding to three broadsheet pages.

8. The offset printing machine of claim 1, wherein the circumferential length and the longitudinal length of the outer surface of the form cylinder is configured such that said first print page array arranged on said at least one flexible printing plate is interchangeable with a second print page array arranged on at least another flexible printing plate, wherein each of said first print array and said second print array is independently fittable within the outer surface of the form cylinder, the second print page array being in a tabloid format and comprising two tabloid pages in the circumferential length and at least four tabloid pages in the longitudinal length.

9. The offset printing machine of claim 2, wherein the circumferential length and the longitudinal length of the outer surface of the form cylinder is configured such that said first print page array arranged on said at least one flexible printing plate is interchangeable with a second print page array arranged on at least another flexible printing plate, wherein each of said first print array and said second print array is independently fittable within the outer surface of the form cylinder, the second print page array being in a tabloid format and comprising two tabloid pages in the circumferential length and at least four tabloid pages in the longitudinal length.

10. The offset printing machine of claim 1, wherein a ratio of said circumferential length of said transfer cylinder to said circumferential length of said form cylinder is 2:1.

11. The offset printing machine of claim 1, wherein said means for receiving at least one flexible printing plate comprises means for receiving four flexible printing plates, wherein each of said four printing plates comprises a height and a width, the circumferential length of said form cylinder being sized for receiving only one height of said four flexible printing plates and the longitudinal length of said form cylinder being sized for receiving four widths of said four flexible printing plates, wherein one broadsheet page is fittable on each one of said four flexible printing plates.

12. The offset printing machine of claim 8, wherein said means for receiving at least one flexible printing plate comprises means for receiving four flexible printing plates, wherein each of said four printing plates comprises a height and a width, the circumferential length of said form cylinder being sized for receiving only one height of said four flexible printing plates and the longitudinal length of said form cylinder being sized for receiving four widths of said four flexible printing plates, wherein two tabloid pages are fittable on each one of said four flexible printing plates.

13. The offset printing machine of claim 8, wherein said at least one flexible printing plate is interchangeable with at least another flexible printing plate for producing in one stage four tabloid pages in a landscape arrangement on said form cylinder of variable products in tabloid format.

14. The offset printing unit of claim 9, wherein said at least one flexible printing plate is interchangeable with at least another flexible printing plate for producing in one stage a product in tabloid format having a set of one of sixteen, twelve, eight and four tabloid pages using a printing material web having a web width respectively corresponding to one of four, three, two, and one tabloid pages.

15. The offset printing machine of claim 9, wherein said at least one flexible printing plate is interchangeable with at least another flexible printing plate for producing in one stage a first and second product in tabloid format, each said first and second products comprising one set of tabloid pages;

said first product comprising a set of one of four tabloid pages and eight tabloid pages and said second product comprising, respectively, a set of one of eight tabloid pages and twelve tabloid pages when the printing material web comprises a web width corresponding to four tabloid pages; and said first product comprising a set of four tabloid pages and said second product comprising a set of eight tabloid pages when the printing material web comprises a web width corresponding to three tabloid pages.

* * * * *